US009463949B2

(12) United States Patent
Watkins

(10) Patent No.: US 9,463,949 B2
(45) Date of Patent: Oct. 11, 2016

(54) ZERO TURN RADIUS REEL

(71) Applicant: Sonoco Development, Inc., Hartsville, SC (US)

(72) Inventor: Eric Watkins, Lugoff, SC (US)

(73) Assignee: Sonoco Development, Inc., Hartsville, SC (US)

( * ) Notice: Subject to any disclaimer, the term of this patent is extended or adjusted under 35 U.S.C. 154(b) by 282 days.

(21) Appl. No.: 14/248,806

(22) Filed: Apr. 9, 2014

(65) Prior Publication Data

US 2015/0291385 A1 Oct. 15, 2015

(51) Int. Cl.
*B65H 75/18* (2006.01)
*B65H 75/14* (2006.01)

(52) U.S. Cl.
CPC ..... *B65H 75/18* (2013.01); *B65H 75/14* (2013.01)

(58) Field of Classification Search
CPC ..... B65H 75/14; B65H 75/18; B65H 75/22; B65H 75/30
USPC ..... 242/608–608.3, 118.6
See application file for complete search history.

(56) References Cited

U.S. PATENT DOCUMENTS

| | | | | |
|---|---|---|---|---|
| 2,452,378 A | 10/1948 | Hudson | | |
| 3,614,008 A | 10/1971 | Stark | | |
| 5,954,294 A * | 9/1999 | Forsner | B65H 54/58 | 242/601 |
| 2008/0245920 A1 * | 10/2008 | Houen | B65H 75/22 | 242/407.1 |

FOREIGN PATENT DOCUMENTS

FR WO 2008132416 A1 * 11/2008 ..... B65H 75/22

* cited by examiner

*Primary Examiner* — William E Dondero
(74) *Attorney, Agent, or Firm* — Miller, Matthias & Hull LLP

(57) ABSTRACT

An easy-to-maneuver reel for carrying wound product is provided. The reel comprises at least one flange that can rotate independently of the drum.

5 Claims, 7 Drawing Sheets

(First Embodiment)

(First Embodiment)

(First Embodiment)

(First Embodiment)

(First Embodiment)

(Second Embodiment)

(Second Embodiment)

(Second Embodiment)

(Second Embodiment)

ZERO TURN RADIUS REEL

BACKGROUND OF THE INVENTION

1. Field of the Invention

This disclosure relates to a reel of the kind used to hold and transport wound materials. More particularly, this disclosure relates to a reel that is easy to maneuver the reel by hand, especially changing directions and navigating tight spaces.

2. Description of the Related Art

Reels of the kind described herein are used to hold and transport wound materials such as cable, wire and other strand-like materials as well as sheet-like materials such as paper, film and fabric. Current reel designs make it difficult to maneuver the reel by hand, especially changing directions and navigating tight spaces. The present invention addresses these problems.

BRIEF SUMMARY OF THE INVENTION

The present invention is a reel for carrying wound product that is easy to maneuver, especially in changing directions and navigating tight spaces. The reel comprises at least one flange that can rotate independently of the drum.

In a first embodiment the reel comprises a drum assembly and first and second flanges. The drum assembly comprises a drum, first and second drum extensions and drum plates. The drum may be substantially cylindrical and define an axis and is configured to receive wound product. The first and second drum extensions extend axially outward from the first and second ends of the drum. A drum plate is affixed to each end. The first (fixed) flange is mounted to the first drum extension and may be fixed with respect to the drum.

The second (rotatable) flange is mounted to the second drum extension. The second flange comprises a center ring rotatably mounted to the second drum extension, spokes extending radially outward from the center ring and having distal ends, a rim affixed to the distal ends of the spokes, and a plurality of fastener receiving plates disposed between adjacent spokes and having openings therein.

An outer plate is mounted to the second drum extension on a side of the second flange away from the second drum plate so as to capture the second flange between the second drum plate and the outer plate. The outer plate defines a plurality of openings for receiving fasteners.

The fasteners are moveable between a locked position in which the fasteners extend through the openings in the outer plate and into the openings in the fastener receiving plates to lock the second flange in stationary relationship to the second drum extension, and an unlocked position in which the fasteners do not extend into the openings in the fastener receiving plates, thereby allowing the second flange to rotate with respect to the second drum extension. Preferably the fasteners are spring loaded pins biased in the locked position.

The reel may further comprise a locking ring mounted to the second drum extension on a side of the outer plate away from the flange, the locking ring defining a plurality of openings, wherein the fasteners extend through the plurality of locking ring openings.

In a second embodiment a reel is provided comprising a drum assembly, first and second flanges and a locking assembly. The drum assembly comprises a drum, a drum extension, first and second drum plates and a slewing ring bearing. The drum defines an axis, has opposing first and second ends, and is configured to receive wound product.

The drum extension extends axially outward from the first end and holds the first (fixed) flange. The first drum plate is affixed to the first drum end while the second drum plate is affixed to the opposite, second, drum end.

The slewing ring bearing comprises a fixed race and a rotatable race configured to rotate independently of each other. The fixed race is mounted in a fixed relationship to the second drum plate. The rotatable race defines fastener receiving openings.

The second (rotatable) flange is mounted to the end of the drum assembly opposite the first flange via the slewing ring bearing. The second flange comprises a hub, an outer plate mounted to the hub, an outer ring mounted to the outer plate, spokes extending radially outward from the outer ring and having distal ends, and a rim affixed to the distal ends of the spokes. The second flange outer plate is affixed to the rotatable race with fasteners. The reel further comprises at least one locking assembly mounted to the reel and moveable between a locked configuration in which the second flange is mounted to the drum assembly in fixed relationship therewith, and an unlocked configuration in which the second flange is freely rotatable with respect to the drum assembly.

In a further aspect of the second embodiment, each locking assembly comprises an outer block mounted to the second flange outer ring, an inner block mounted to the second drum plate, and a fastener configured to releasably lock the outer block to the inner block. The fastener may be a spring loaded plunger which preferably biases the locking mechanism in the locked position.

DETAILED DESCRIPTION OF THE INVENTION

Figure 1:
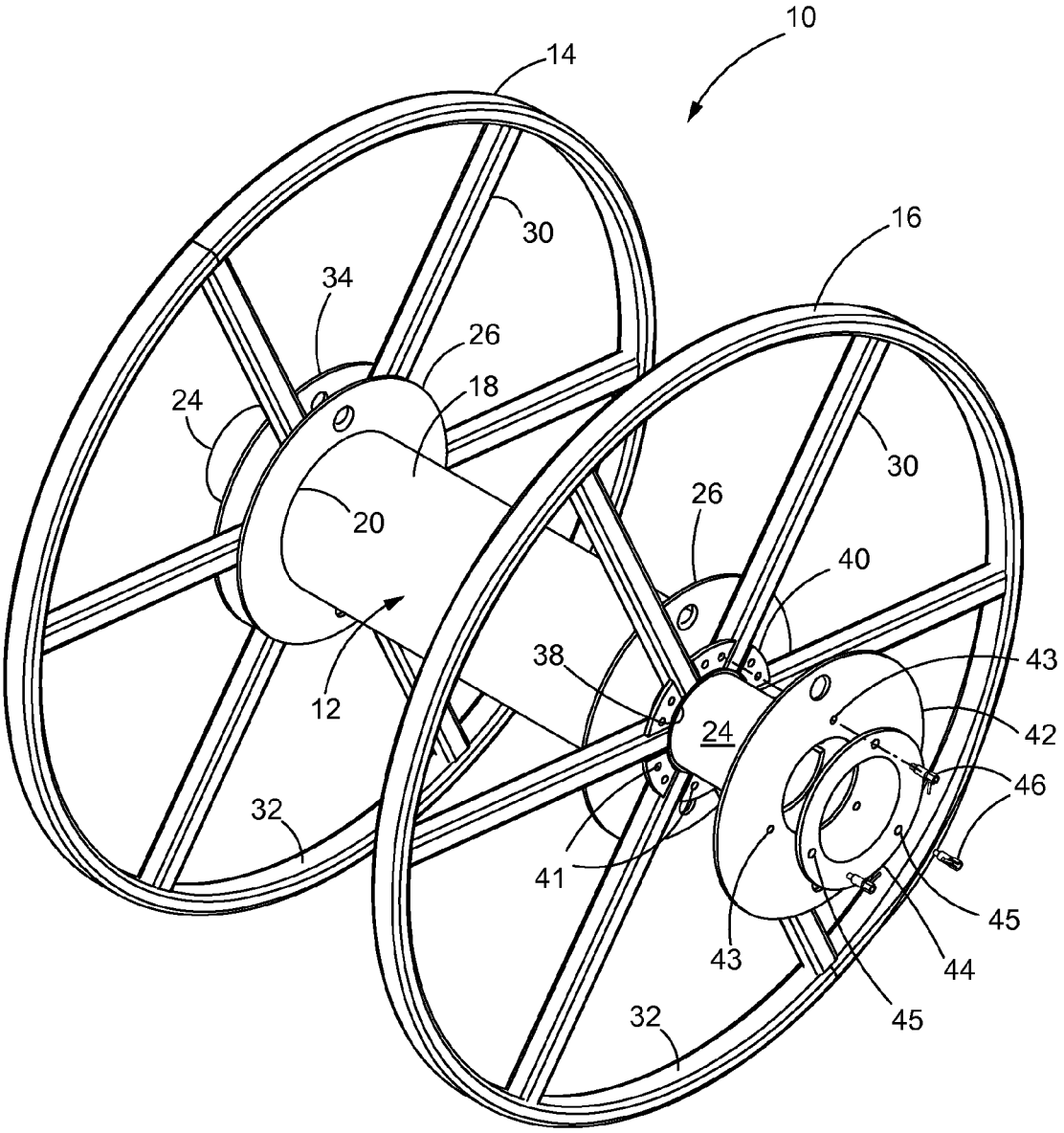
FIG. 1 is a perspective view of a first embodiment of a reel according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The present invention is a "zero turn radius" reel that is easy to maneuver by hand, especially changing directions and navigating tight spaces. The reel comprises a drum assembly for carrying wound product, a first (typically stationary) flange and a second (rotatable) flange attached to either end of the drum assembly. By allowing the second flange to rotate with respect to the drum assembly, an operator can easily maneuver the reel in tight spaces. There are two embodiments of the zero turn radius reel, a friction embodiment and a bearing embodiment.

First Embodiment

Figure 3:
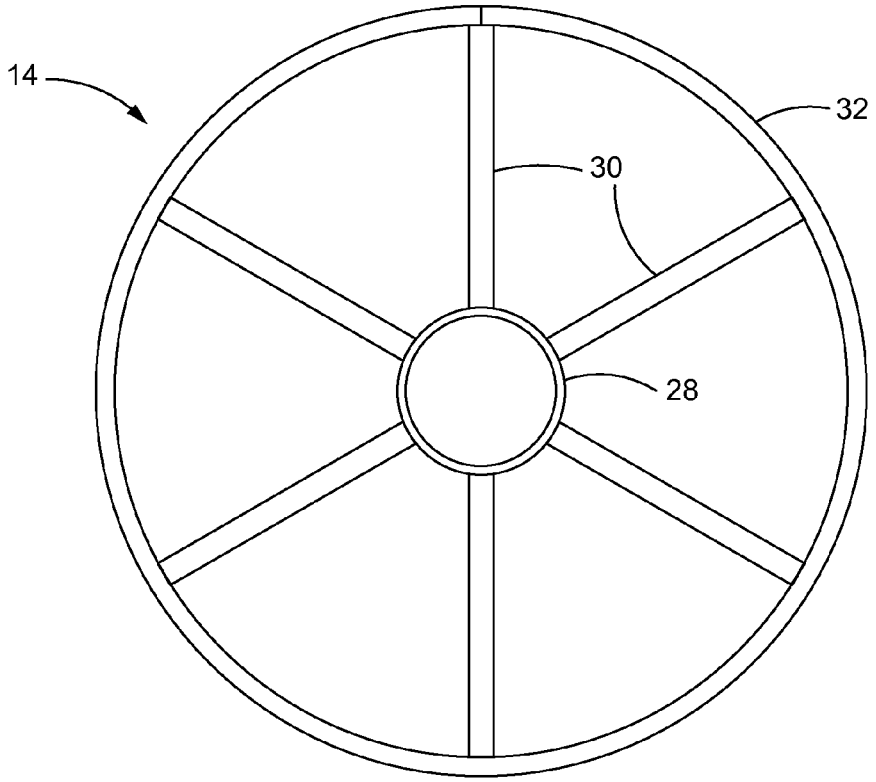
FIG. 3 is a side view of a flange for use with the reel of FIG. 1.
Figure 2:
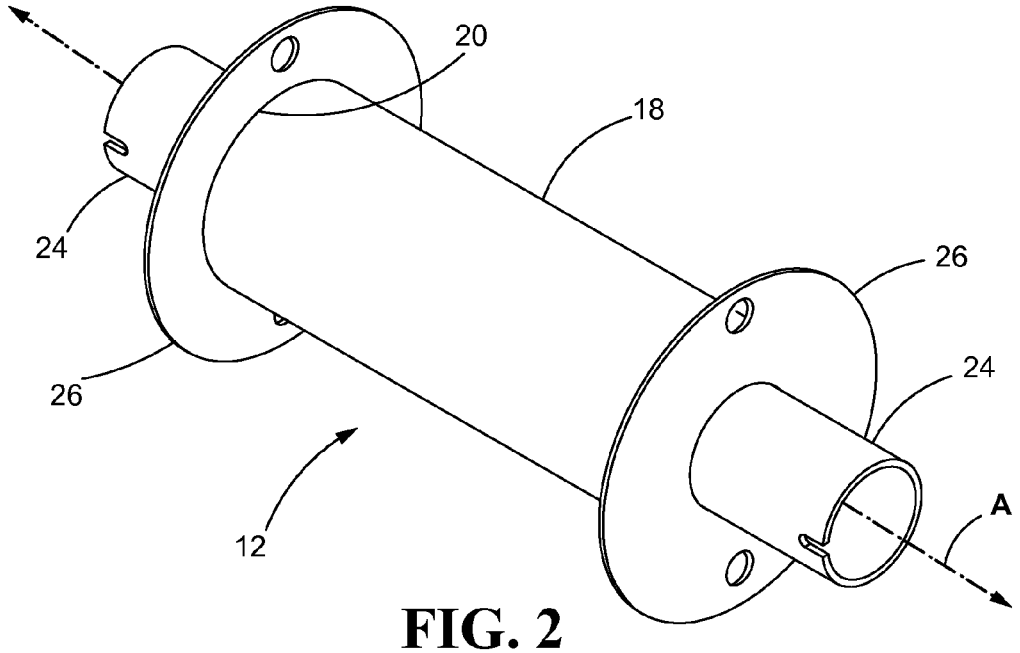
FIG. 2 is a perspective view of the drum assembly component of the reel of FIG. 1.

Referring to the attached FIGS. 1-3 and, in particular, FIG. 1, the first (friction) embodiment reel 10 comprises a drum assembly 12, a first (stationary) flange 14 and a second (rotatable) flange 16. The first flange 14 is affixed to the drum assembly 12 in stationary relationship therewith. The second flange 16 is affixed to the drum assembly 12 but can move with respect to the drum assembly 12 as explained below.

As best shown in FIG. 2, the drum assembly 12 comprises a large diameter drum 18, smaller diameter extensions 24 and drum plates 26. The drum 18 has opposing first and second ends 20, defines an axis A and is configured to receive wound product. The small diameter extensions 24 are rigidly fixed to the drum 18 and extend axially outward from each of the first and second ends 20. The annular drum plates 26 are affixed to each of the first and second ends 20.

As shown in FIG. 3 the first (fixed) flange 14 comprises a substantially cylindrical first flange center ring 28, spokes 30 and a rim 32. The flange center ring 28 may have an inner diameter slightly larger than the outer diameter of an extension 24 so that the first flange 14 can slide onto the extension 24 during assembly. The spokes 30 extend radially outward from the flange center ring 28 and have distal ends. The rim 32 is affixed to the distal ends of the spokes 30.

Referring again to FIG. 1, the first flange 14 is affixed to the drum assembly 12, preferably in stationary relationship therewith. For example, the flange center ring 28 (obscured in FIG. 1) may be rigidly affixed (such as by welding) to the extension 24. Alternatively or in addition, the spokes 30 may be affixed (such as by welding) to the drum plate 26. An outer plate 34 may be mounted on the extension 24 to capture the first flange 14. The outer plate 34 may be welded or otherwise affixed to the extension 24.

Figure 4:
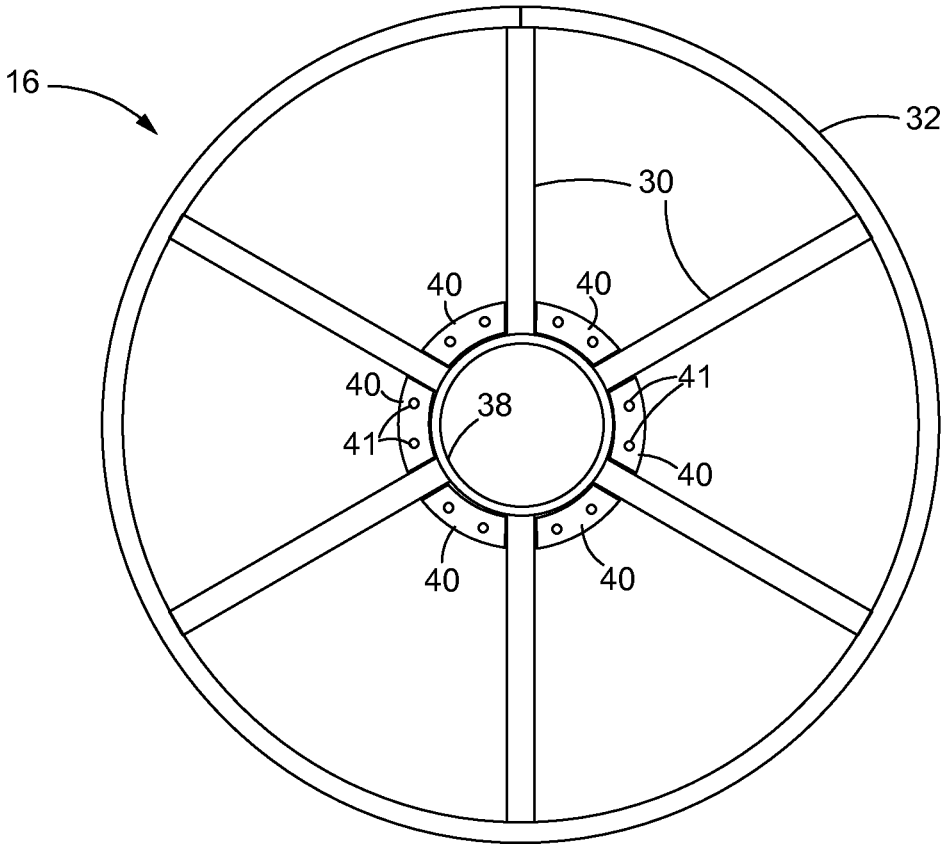
FIG. 4 is a side view of a flange for use with the reel of FIG. 1.

As shown in FIG. 4, the second (rotatable) flange 16 comprises a low friction center ring 38, spokes 30, a rim 32 and fastener receiving plates 40. The center ring 38 has a diameter slightly larger than the drum extension 24 so that center ring 38, and thus the second flange 16, can slide onto the extension 24 during assembly and rotate with respect to the extension 24 during use. The spokes 30 extend radially outward from the center ring 38 and have distal ends. The rim 32 is affixed to the distal ends of the spokes 30.

The second flange 16 further comprises a plurality of radially arranged, preferably arcuate, fastener receiving plates 40, each fastener receiving plate 40 configured to fit between adjacent spokes 30. The fastener receiving plates 40 may be affixed, as by welding or other means, to the center ring 38 and/or the spokes 30.

Referring again to FIG. 1, the reel 10 further comprises an annular outer plate 42 that slides over the extension 24 so that the second flange 16 is captured between the outer plate 42 and the drum plate 26. The outer plate 42 may be welded or otherwise affixed to the extension 24. The outer plate 42 has at least one opening 43 therein for receiving fasteners 46. A locking ring 44 is slid over the extension 24 and has at least one opening 45 therein for receiving the fasteners 46. When assembled, the openings 43 in the outer plate 42 align with the openings 45 in the locking ring 44 and with openings 41 in the plates 40.

The fasteners 46 may be bolts or, preferably, spring loaded pins. The fasteners 46 have two positions. In a first (locked) position the fasteners 46 extend through the openings 45 in the locking ring 44, the openings 43 in the outer plate 42 and into the openings 41 in the plates 40 to secure the second flange 16 in stationary relationship to the extension 24. In a second (open) position, the fasteners 46 do not extend into the openings 41 in the plates 40, thereby allowing the second flange 16 to rotate with respect to the extension 24.

The second flange 16 can be locked in multiple positions with respect to the drum assembly 12 because of the multiple sets of openings 41 in the fastener receiving plates 40.

In a variation, in place of the openings 41 in the fastener receiving plates 40, holes may be formed in the spokes and used to receive the fasteners 46, eliminating the need for the fastener receiving plates 40.

Second Embodiment

Figure 5:
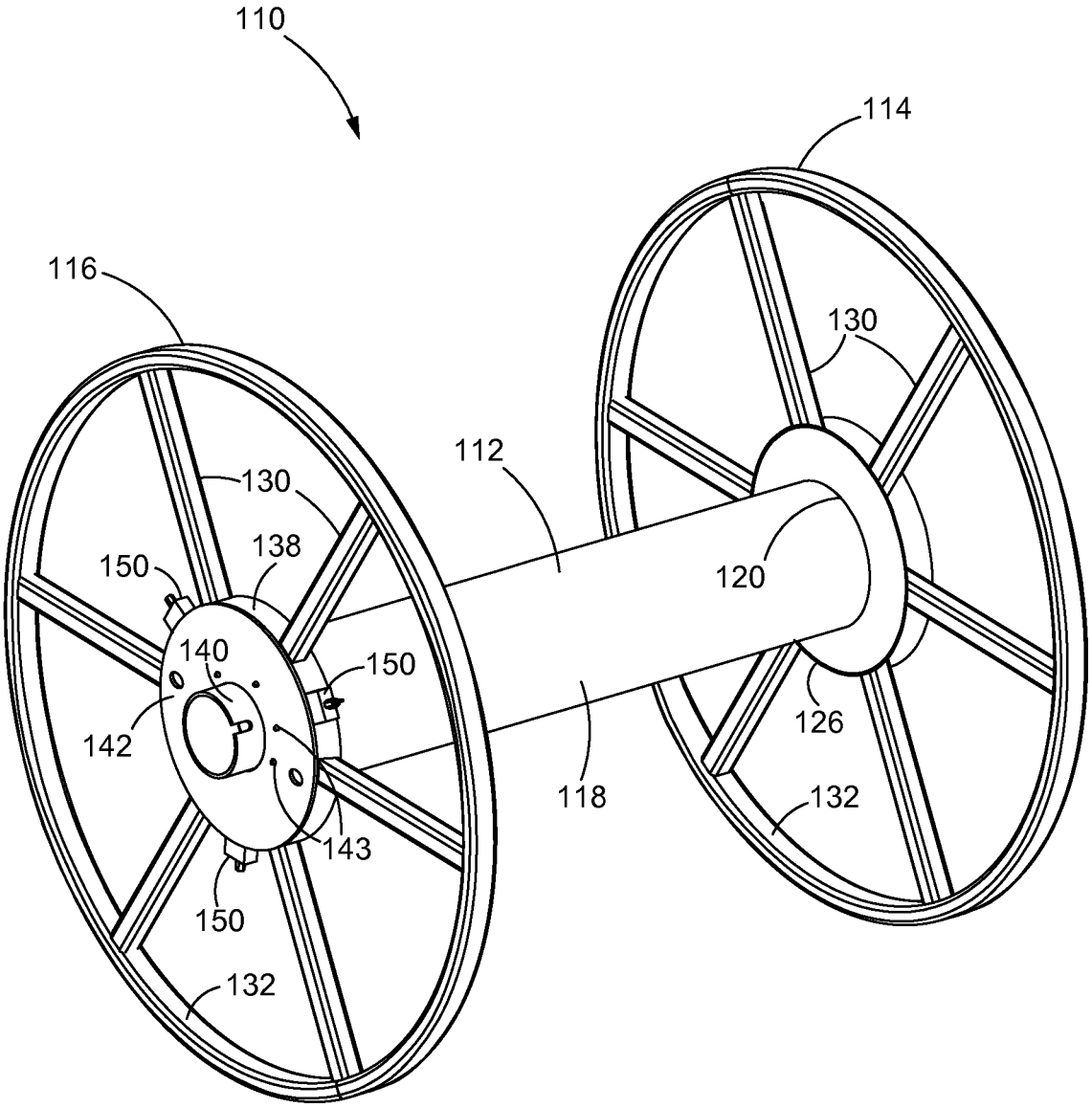
FIG. 5 is a perspective view of a second embodiment of a reel according to the disclosure.

Referring to FIG. 5, the second (slewing ring bearing) embodiment 110 comprises a drum assembly 112, a first (stationary) flange 114, a second (rotatable) flange 116 and a slewing ring bearing 144 (obscured in FIG. 5) to allow rotational movement of the second flange 116 with respect to the drum assembly 112.

Figure 6:
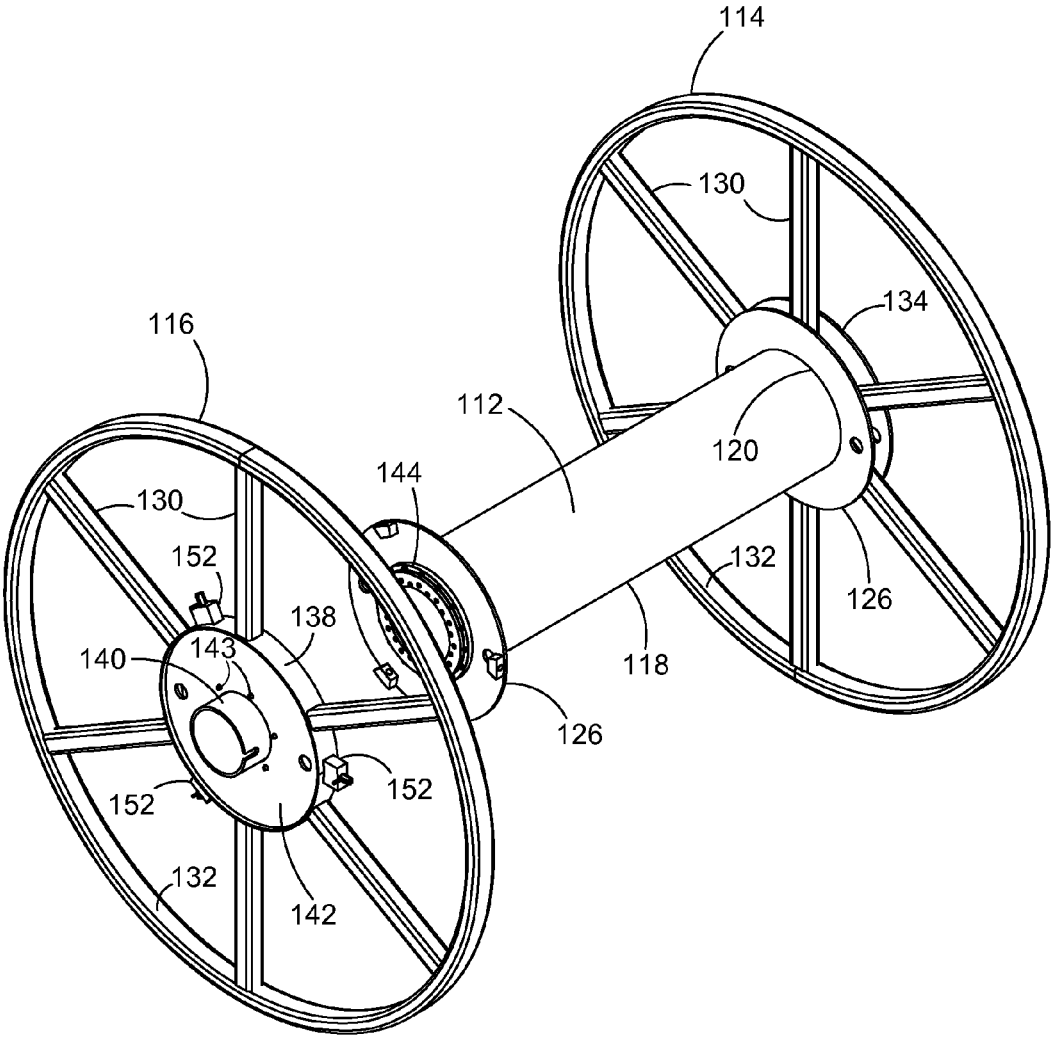
FIG. 6 is a partial exploded perspective view of the reel of FIG. 5.
Figure 7:
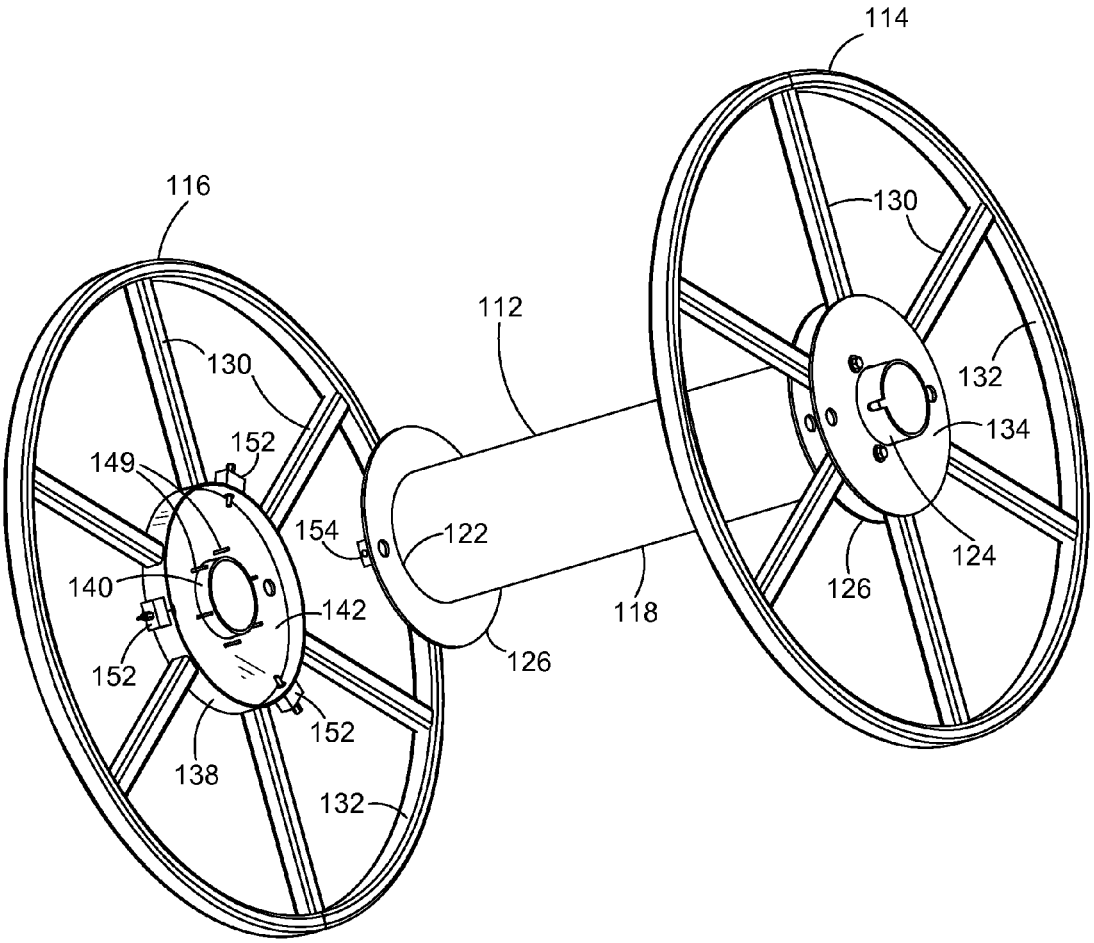
FIG. 7 is another partial exploded perspective view of the reel of FIG. 5.

FIGS. 6 and 7 are partial exploded perspective views of the reel 110 of FIG. 5 taken from different perspectives. The drum assembly 112 comprises a drum 118, a small diameter extension 124 (see FIG. 7) and drum plates 126. The drum 118 has opposing first and second ends 120, 122 and is configured to receive wound product. As shown in FIG. 7, the extension 124 extends axially outward from the first end 120. The drum plates 126 are affixed to the first and second ends 120, 122.

The first (stationary) flange 114 may be rigidly attached to the drum 118 in any suitable manner. For example, like the first flange 14 of the first embodiment, the first flange 114 of this second embodiment may comprise a flange center ring (not shown in the figures, but similar to the flange center ring 28 shown in FIG. 3) having an inner diameter slightly larger than the outer diameter of the extension 124 so that the first flange 114 can be mounted over the extension 124. The first flange 114 further comprises spokes 130 extending radially outward from the flange center ring and having distal ends and a circular rim 132 affixed to the distal ends of the spokes 130. The flange center ring may be welded to the extension 124 and the spokes 130 may be welded to the drum plate 126. An annular outer flange plate 134 may be mounted on the extension 124 on the side of the first flange 114 away from the drum 118 to capture the first flange 114 therebetween.

The second (rotatable) flange 116 is capable of rotational movement with respect to the drum assembly 112, and comprises an outer ring 138, spokes 130 extending radially outward from the outer ring 138 and having distal ends, and a rim 132 affixed to the distal ends of the spokes 130.

The second flange 116 also comprises an inner ring or hub 140 and an outer plate 142. The hub 140 is concentric with but has a diameter smaller than the outer ring 138. The hub 140 may slip into an opening in the outer plate 142 and may be configured to receive a winder. The outer plate 142 may be welded or otherwise affixed to the outer ring 138 and hub 140.

Figure 8:
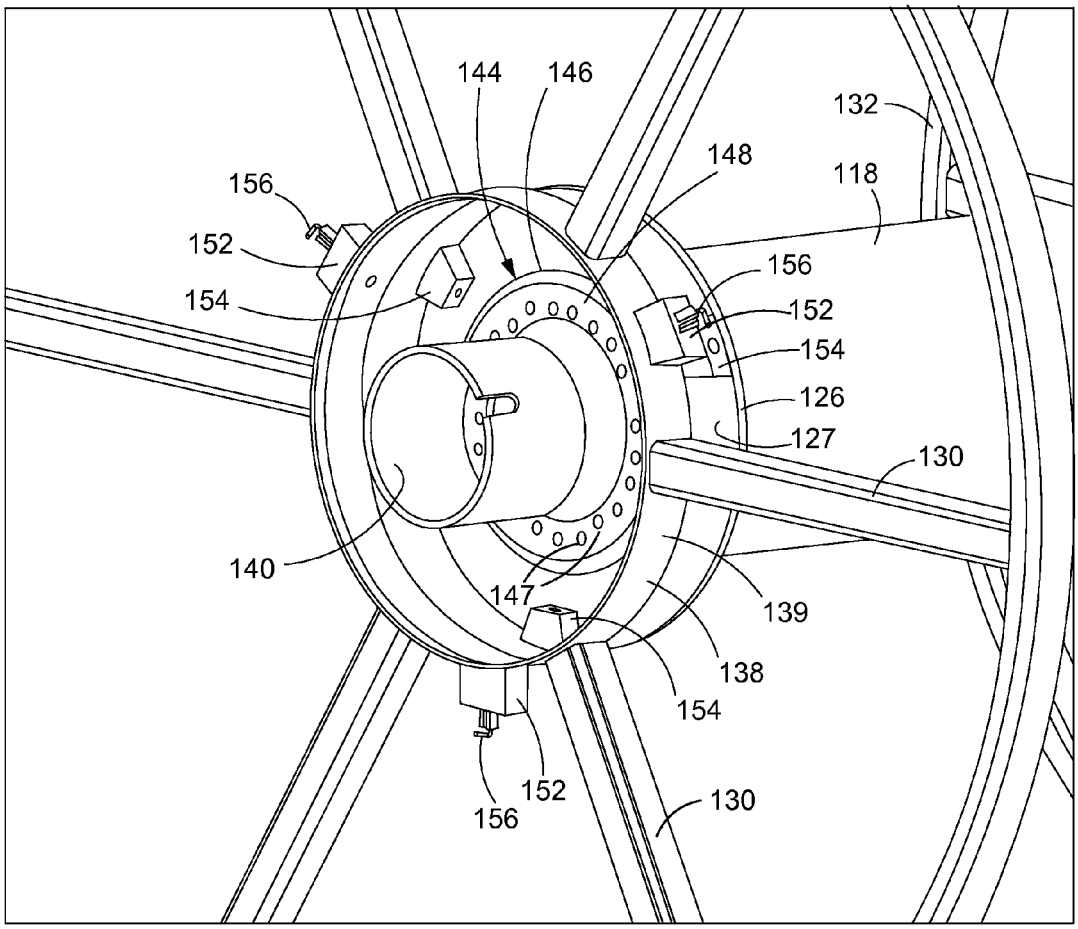
FIG. 8 is a close up partial exploded perspective view of a portion of the reel of FIG. 5.

FIG. 8 is a close up partial exploded perspective view of a portion of the reel 110 of FIG. 5 showing in greater detail the mechanism for rotating the second flange 116 independently of the drum 118, with the second flange outer plate 142 removed to better show the slewing ring bearing 144. The slewing ring bearing 144 comprises an annular stationary race 146, so named because it is stationary with respect to (that is, rigidly affixed to) the drum assembly 112, and an annular rotatable race 148, so named because it can rotate with respect to the drum assembly 112. Each race 146, 148 may define fastener openings. The stationary race 146 and the rotatable race 148 are concentric and are configured to rotate independently of each other. The stationary race 146 may be affixed to the drum plate 126 as with bolts.

As perhaps best shown in FIG. 7, the second flange outer plate 142, and thus the second flange 116, is mounted to the rotatable race 148 with fasteners 149. For example, the fasteners 149 may be bolts that extend through openings 143 in the outer plate 142 and into openings 147 in the rotatable race 148.

Referring again to FIG. 8, the hub 140 may extend partly within the rotatable race 148 and there may be a gap between the hub 140 and the rotatable race 148. The drum plate 126 may fit within the outer ring 138 but has a smaller diameter so that the outer ring 138 and thus the flange 116 can rotate with respect to the drum plate 126 to allow free rotational movement of the second flange 116 relative to the drum assembly 112.

The reel 110 may further comprise at least one locking assembly 150 for locking the second (rotatable) flange 116 to the drum assembly 112. The locking assemblies 150 are mounted to the reel 110 and moveable between a locked configuration in which the second flange 116 is mounted to the drum assembly 112 in fixed relationship therewith, and an unlocked configuration in which the second flange 116 is freely rotatable with respect to the drum assembly 112.

Each locking assembly 150 may comprise a threaded outer block 152 mounted to the outer radial surface 139 of the second flange outer ring 138, an inner block 154 mounted to the outer axial surface 127 of the drum plate 126, and a locking mechanism 156 such as a spring loaded plunger. The locking mechanism 156 may be affixed to the outer block 152 and is configured to releasably lock together the outer block 152 and the inner block 154.

The locking mechanisms 156 may be spring loaded plungers biased in the locked position, that is, the position in which the outer block 152 and the inner block 154 are locked together. When a user wants to unlock the second flange 116 so that it can rotate with respect to the drum 118 in order to, say, make a sharp turn, the user pulls or otherwise manipulates the spring loaded plungers 156 so that they are disengaged from the inner blocks 154 and thus in the unlocked position.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A reel comprising:

a drum assembly comprising a drum, first and second drum extensions and drum plates, the drum defining an axis and having opposing first and second ends and configured to receive wound product, the first and second drum extensions extending axially outward from the first and second ends, a drum plate being affixed to each of the first and second ends;

a first flange mounted to the first drum extension;

a second flange mounted to the second drum extension, the second flange comprising a center ring rotatably mounted to the second drum extension, spokes extending radially outward from the center ring and having distal ends, a rim affixed to the distal ends of the spokes, and a plurality of fastener receiving plates disposed between adjacent spokes and defining openings therein;

an outer plate nonrotatably mounted to the second drum extension on a side of the second flange away from the second drum plate so as to capture the second flange between the second drum plate and the outer plate, the outer plate defining a plurality of openings for receiving fasteners; and a plurality of fasteners; wherein the fasteners are moveable between a locked position in which the fasteners extend through the openings in the outer plate and into the openings in the fastener receiving plates to secure the second flange in stationary relationship to the second drum extension, and an unlocked position in which the fasteners do not extend into the openings in the fastener receiving plates, thereby allowing the second flange to rotate with respect to the second drum extension.

2. The reel of claim 1 wherein the fasteners are spring loaded pins.

3. The reel of claim 1 wherein the fastener receiving plates define multiple sets of openings, thereby allowing the second flange to be locked in multiple positions with respect to the second drum extension.

4. The reel of claim 1 further comprising:

a locking ring mounted to the second drum extension on a side of the outer drum plate away from the flange, the locking ring defining a plurality of openings; and wherein the fasteners extend through the plurality of locking ring openings in at least the locked position.

5. The reel of claim 4 wherein:

the openings in the locking ring, the openings in the outer plate and at least some of the openings in the fastener receiving plates are axially aligned.

* * * * *